US007891576B2

(12) United States Patent
Bögl

(10) Patent No.: US 7,891,576 B2
(45) Date of Patent: Feb. 22, 2011

(54) TRACK SYSTEM AND CONCRETE SLAB OF A FIXED TRACK

(75) Inventor: Stefan Bögl, Sengenthal (DE)

(73) Assignee: Max Bogl Bauunternehmung GmbH & Co. KG, Sengenthal (DE)

( * ) Notice: Subject to any disclaimer, the term of this patent is extended or adjusted under 35 U.S.C. 154(b) by 419 days.

(21) Appl. No.: 11/909,000

(22) PCT Filed: Mar. 22, 2006

(86) PCT No.: PCT/EP2006/060931

§ 371 (c)(1),
(2), (4) Date: Sep. 18, 2007

(87) PCT Pub. No.: WO2006/100252

PCT Pub. Date: Sep. 28, 2006

(65) Prior Publication Data

US 2008/0230621 A1 Sep. 25, 2008

(30) Foreign Application Priority Data

Mar. 22, 2005 (DE) ..... 10 2005 013 736

(51) Int. Cl.
*E01B 21/00* (2006.01)

(52) U.S. Cl. ..... 238/2; 238/8; 238/7; 238/5; 238/6

(58) Field of Classification Search ..... 238/2–8
See application file for complete search history.

(56) References Cited

U.S. PATENT DOCUMENTS 5,163,614 A * 11/1992 Tamas et al. ..... 238/2
6,237,856 B1 * 5/2001 Bachmann et al. ..... 238/7
6,415,987 B2 * 7/2002 Vincent et al. ..... 238/2
6,488,215 B2 * 12/2002 Mohr ..... 238/2

(Continued)

FOREIGN PATENT DOCUMENTS

DE 1926252 11/1965

(Continued)

OTHER PUBLICATIONS

EPO Search Report, Jun. 29, 2006.

(Continued)

*Primary Examiner*—S. Joseph Morano
*Assistant Examiner*—Jason C Smith
(74) *Attorney, Agent, or Firm*—Dority & Manning, P.A.

(57) ABSTRACT

The invention relates to track system having two substantially parallel tracks (6) which are disposed on respective concrete slabs (1) of a fixed track. The slabs (1) comprises a plurality of track supports (2, 2') for receiving and fastening thereon two parallel rails (5). The top surfaces (3) of the slabs (1) of the two tracks (6) are inclined independent of the a guiding system of the tracks (6) and of the corresponding position of the rail supports (2, 2') relative to the two outer sides (8) of the track system and form a slope. The invention also relates to a concrete slab of a fixed track, which comprises supports (2, 2') for the first rail (5) which are higher in relation to the top surface (3) of the slab (1) than the supports (2, 2') for the second rail (5).

15 Claims, 4 Drawing Sheets

U.S. PATENT DOCUMENTS

| | | | | |
|---|---|---|---|---|
| 6,954,974 | B2 * | 10/2005 | Rada | 29/423 |
| 7,500,617 | B2 * | 3/2009 | Wirtz et al. | 238/2 |
| 2001/0048033 | A1 * | 12/2001 | Vincent et al. | 238/2 |
| 2008/0173724 | A1 * | 7/2008 | Frenzel | 238/2 |
| 2008/0230621 | A1 * | 9/2008 | Bogl | 238/25 |
| 2009/0152368 | A1 * | 6/2009 | Frenzel | 238/2 |
| 2009/0242654 | A1 * | 10/2009 | Jay | 238/2 |

FOREIGN PATENT DOCUMENTS

| | | | |
|---|---|---|---|
| DE | 23 54 958 | | 6/1975 |
| DE | 40 07 710 | A1 | 9/1991 |
| DE | 198 08 867 | A1 | 9/1999 |
| EP | 1619305 | A2 * | 1/2006 |

OTHER PUBLICATIONS

International Preliminary Report on Patentability, Oct. 19, 2007.
German Patent Office Search Report, Jan. 20, 2006.

* cited by examiner

TRACK SYSTEM AND CONCRETE SLAB OF A FIXED TRACK

FIELD OF THE INVENTION

The present invention relates to a track system with two tracks largely parallel to one other and arranged on concrete slabs. The slabs have numerous rail supports for receiving and fastening thereon two rails parallel to one another and a corresponding fixed track concrete slab.

BACKGROUND

When tracks are laid in the conventional way on a ballast track, rainwater seeps through the track ballast and is led along a subgrade protective layer towards the exterior. Thus, rainwater is largely prevented from accumulating near the tracks. However, tracks resting on a ballast track are disadvantageous for high-speed railroad traffic, and therefore a fixed rail track is installed most of the time. In the fixed track, a hydraulically-bound supporting layer is built directly on the subgrade protective layer, after which the fixed track is laid on the supporting layer. The former is made of concrete mixed in situ or of pre-assembled slabs. In the case of the fixed tracks made of concrete mixed in situ, pre-fabricated ties or rail supports are often laid exactly on position and finally poured with concrete mixed in situ. If the fixed track is made from pre-assembled concrete, then they already come with rail supports. The pre-assembled concrete slabs are finally laid on the hydraulically-bound supporting layer and fastened.

In both types of fabrication, the fixed track is built with a superelevation in the area of transition curves and radii. In other words, the delivered slab for the fixed track made of pre-fabricated concrete or concrete mixed in situ is built in a sloping way on the respective supporting layer prepared for it. In a track system, which is usually made of at least two tracks largely parallel to one another, rainwater falling on the track located in the interior of the curve flows to the internal outer side of the track system, but rainwater falling on the outer track, on the other hand, will flow between both tracks. The water in this middle area must be forced to flow out with a drainage device installed under the fixed track.

From the engineering standpoint, it is not too difficult to build a new fixed track. However, if a track system must be rebuilt from a ballast track to a fixed track, it can get difficult, since most of the time rail traffic cannot be interrupted and larger rebuilding measures cannot therefore be taken.

SUMMARY

It is therefore task of this invention to provide a track system with a fixed track without the known drainage of the middle section. Additional objects and advantages of the invention will be set forth in the following description, or may be obvious from the description, or may be learned through practice of the invention.

In a track system according to the invention, two tracks largely parallel to one another are arranged in each case on concrete slabs of a fixed track. The slabs have numerous track supports for the placement and fastening of two rails parallel to one another. The top surfaces of the slabs of both tracks are inclined regardless from the railroad line guiding system used and the corresponding position of the rail supports relative to the two outer sides of the track system, forming a slope. This ensures that most of the rainwater falling on the track system will be forced to flow outwards. As a result of this, rainwater will not accumulate between both tracks running parallel to one another and therefore does not have to be drained from between the tracks. A drainage system for the middle section is no longer needed. This is especially advantageous when an existing ballast track system is rebuilt for conversion to a track system having a fixed track, especially if the rebuilding project must be carried out without interrupting rail traffic and keeping at least one track open if possible.

If the track is superelevated in the area of the curve, then the level of the outer-curve rail of a track is arranged higher than the inner curve of the rail. In conventional fixed tracks, the slab on which the rails are fastened is laid on the same superelevation. This makes it possible for rainwater to flow towards the inner side of the curve. In spite of the fact that in track systems with at least two tracks running parallel to one another, the inner-curve track forces rainwater to flow towards the internal outer side of the track system, the outer-curve track makes rainwater flow to the middle area between both tracks. From there, it must be forced to flow outwards with a drainage device. According to the invention, it is suggested that in such a case, the outer-curve tracks should have a slab executed against the rail superelevation, therefore being inclined towards the outer-curve external side of the track system. Therefore, rainwater falling on this slab is not forced to flow towards the middle area, but to the outer-curve external side of the track system instead. The sloping of the top surface of the slab and the rail superelevation are thus executed in opposite directions.

Generally speaking, the invention can therefore be described in such a way that the slope of the top surface of the slab has been executed regardless of the rail supports for the rail guide and always remains inclined so that a laid slab creates a sufficient slope towards the outer-curve border of the track.

The slab for the inner-curve track can be executed conventionally if the superelevation creates a sufficient slope towards the culvert; in this case, the superelevation of the track guide runs parallel to the top surface of the corresponding concrete slab. In a very slight superelevation, however, it could also be foreseen for the top surface of the slab to be more inclined than the superelevation of the track guide, thus facilitating a fast drainage towards the outer sides of the track system.

Advantageously, the top surface of every slab is executed so it can form a drainage device towards the outer side of the track system. In this case, it is possible to execute the top surface of the slab with a level surface. However, various individual slopes on the top surface of the slab are also possible for collecting rainwater and making it flow towards one or several defined places of the slab, from which it can flow to the outer side of the track system. The important fact is that the rainwater accumulating in the slab should be largely prevented from flowing into the middle area of the track system. Therefore, corresponding measures must be taken while executing the top surface of the slab so that water can flow unhindered and quickly towards the outer side of the track system, if possible.

In order to prevent rainwater from accumulating in the middle area between both tracks, it is advantageously foreseen for the middle area located between the track slabs to have a slope, at least towards one of the outer sides of the track system. As a result of this, rainwater is reliably diverted from the middle area.

In order to prevent rainwater from banking up between the middle area and the tracks, it is advantageously foreseen for the middle area to be executed at least as high as the top surface of one row of the slabs. Thus, rainwater is forced to flow over the top of the top surface of the slabs and into the outer side of the track system.

A concrete slab according to the invention of a fixed track has many supports for placing and fastening two rails running parallel to one another that jut out from a top surface of the slab. According to the invention and relative to the top surface of the slab, the supports for the first rail are executed higher than the ones for the second rail. As a result of this, the superelevation of the track's railroad line is maintained with respect to the top surface of the slab, which forms a slope that is independently inclined from the required superelevation of the railroad line towards the external sides of the future track system. While usually the top surface of the slab is executed in such a way that most of the individual supports jut out just as high as the top surface of the slab, here the top surface is executed according to the required railroad line. It is essential for the top surface of the slab to be executed so it can allow rainwater to flow against the superelevation of the railroad line as well, thereby forming a slope when the slab is laid so rainwater can be made to flow towards the superelevated rail and therefore to the outer side of the track system.

Advantageously, the top surface of the slab forms a slope that lies opposite the superelevation of the railroad line. On one part of the top surface of the slab, the slope must be correspondingly executed so rainwater can be collected and forced to flow along this sloped track so it can be diverted from this part of the slab.

In an especially simple execution of the slab, the latter is largely executed with uniform thickness. The fabrication, transportation and placement of such a slab are thereby facilitated. According to the invention, the slab is therefore executed to have a uniform thickness with supports that jut out for the first rail in a pre-determined height above the slab's surface, while the supports for the second rail jut out above the top surface of the slab with a second height that differs from the first. Hence, the slab itself has a largely rectangular cross-section.

It is particularly advantageous for the slab to be made of pre-assembled concrete because this standardizes the fabrication of the concrete slab under uniform environmental conditions. The respective pre-assembled concrete is then integrated into the track system at the work site. Another possible alternative would be to lay the rail supports individually or as concrete ties and then to manufacture the concrete slab with concrete mixed in situ. Even in this case, the invention foresees the slope of the concrete layer mixed in situ to be independent from the rail superelevation and executed to facilitate an outflow of the rainwater towards the outer side of the track system.

Preferably, the rail supports are discontinuously laid on the slab. Rainwater can flow out from among the individual rail supports and over the top surface of the slab. In this case, the spaces in between are large enough to allow the expected volume of rainwater to flow out quickly towards the outer side of the track system.

Additional advantages of the invention are described in the following execution examples, which show:

DESCRIPTION

Figure 1:
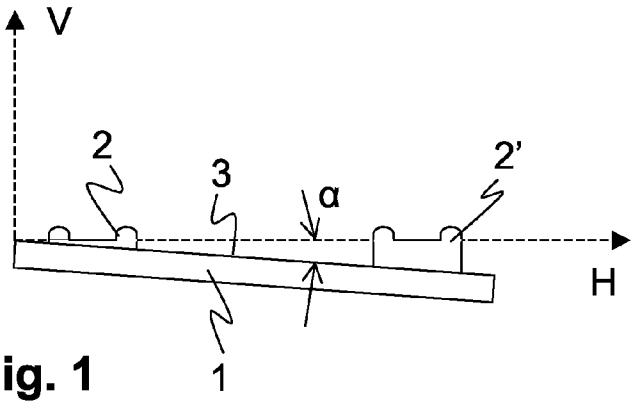
FIG. 1 a diagrammatic representation of a horizontal rail guide.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a diagrammatic representation of a horizontal rail placement. In it, the broken-arrow lines H and V represent the horizontal and vertical directions. Rail supports 2 and 2' have been placed on a concrete slab 1. The rail supports 2 and 2' run along the horizontal line H, so that the rails that will subsequently be assembled on the rail supports 2 and 2' will also be arranged horizontally to one another. The concrete slab 1 has a top surface 3 inclined at an angle $\alpha$ with respect to the horizontal line H. The angle $\alpha$ indicates the slope of the slab 1 which allows rainwater to flow out of the slab 1 towards the rail support 2'. Although the gradient of both rail supports 2 and 2' arranged parallel to one another is horizontal, the surface 3 of the slab 1 still allows rainwater to flow out to a defined outer side. The humps of the rail supports 2' have therefore been made higher than the rail supports 2 compared to the surface 3.

Figure 2:
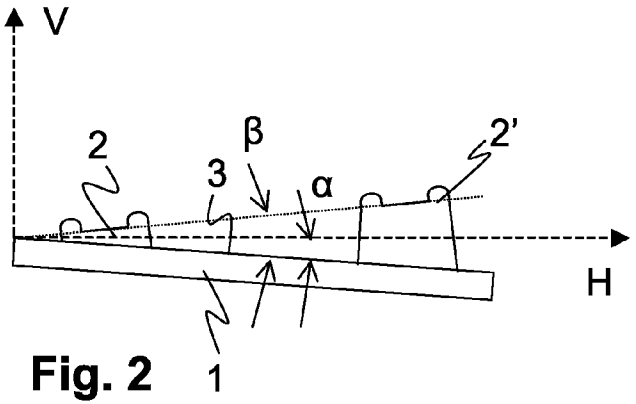
FIG. 2 a diagrammatic representation of a superelevated rail guide.

FIG. 2 shows a diagrammatic representation of a concrete slab 1 according to the invention in which the rail guide is superelevated. Especially in curved tracks, the outer-curve rail is in this case executed higher than the inner-curve rail. In accordance with the illustration shown in FIG. 2, the rail support 2 has been executed lower than the rail support 2' with respect to the horizontal H. Therefore, a superelevation angle $\beta$ is hereby created for both rails. As in FIG. 1, the slab 1 shown in FIG. 2 has been lowered with the angle $\alpha$ with respect to the horizontal H. As a result of this, and opposite the superelevation angle $\beta$, an angle $\alpha$ is formed that creates a slope in the top surface 3 of slab 1 with respect to the horizontal H. Although the track on the rail supports 2 and 2' is inclined towards the middle of the curve, the top surface 3 of the slab 1 is inclined towards the outer side of the curve. As a result of this, rainwater can flow out to the outer side of the track system.

Figure 3:
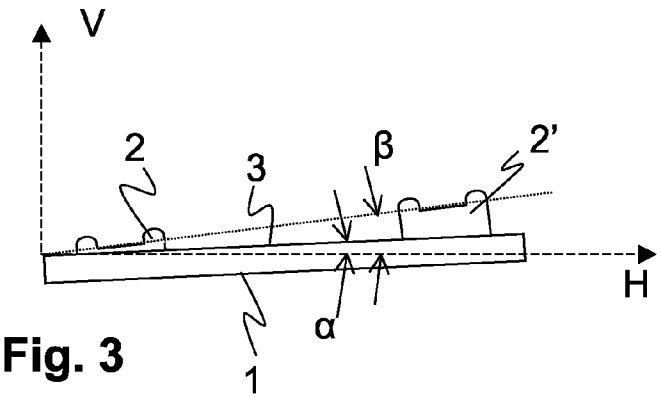
FIG. 3 a diagrammatic representation of a superelevated rail guide with reduced slope.
Figure 4:
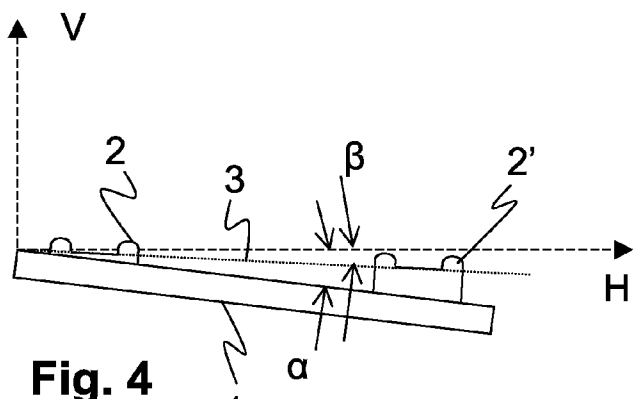
FIG. 4 a diagrammatic representation of a superelevated rail guide with increased slope.

Additional executions and arrangements of the concrete slabs 1 according to the invention are shown in FIGS. 3 and 4. FIG. 3 shows a superelevated rail guide with a reduced slope angle $\alpha$ relative to the superelevation angle $\beta$, whereas FIG. 4 shows a superelevated rail guide with an increased slope angle $\alpha$. In any case, the slope can be chosen according to the corresponding requirements and regardless from the superelevation of the tracks.

Figure 5:
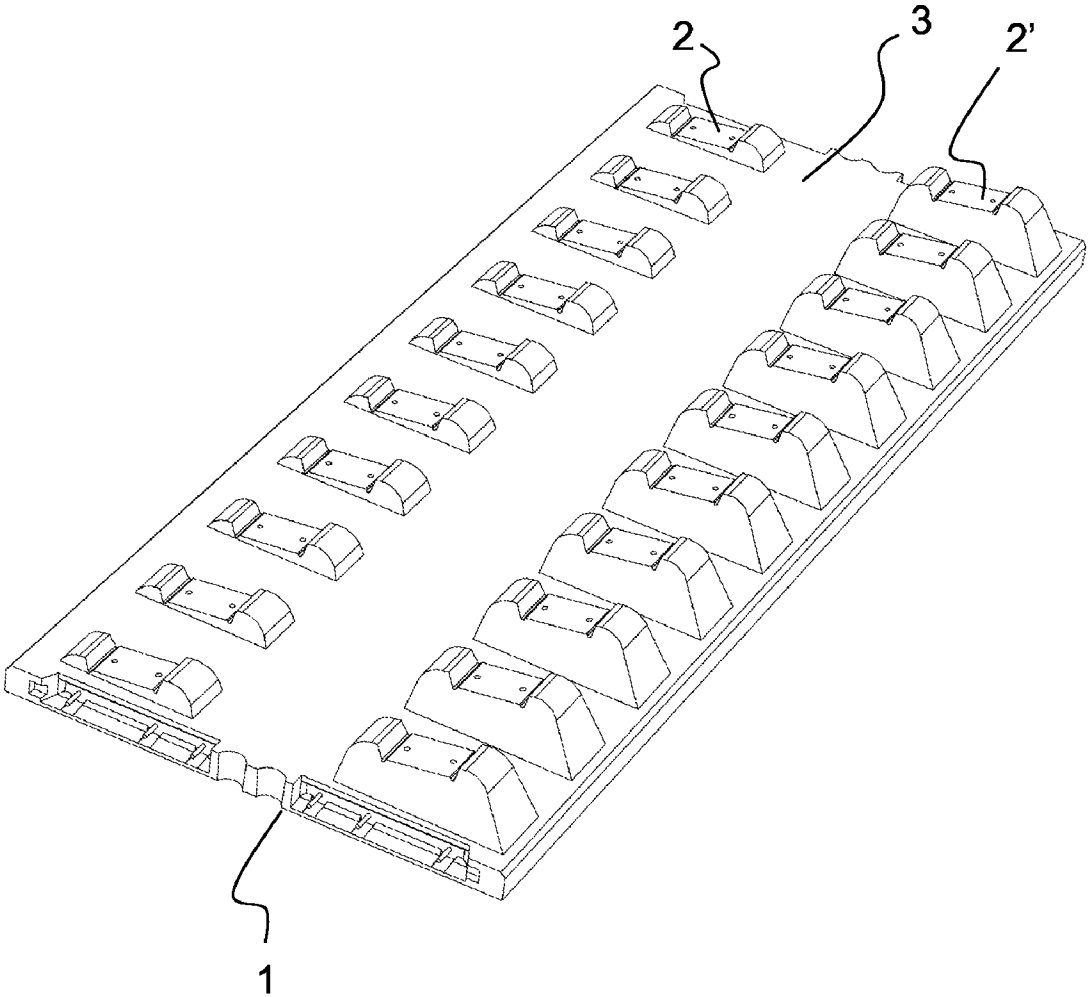
FIG. 5 an execution example of a slab according to the invention with individual supports.

FIG. 5 shows an execution example of a concrete slab 1 made from pre-assembled concrete. Many of these slabs 1 are placed in rows and joined to one another to create a continuous, firm track. Numerous rail supports 2 and 2' have been arranged on slab 1. One rail has been discontinuously laid on every one of the rail supports 2 or 2'. Thanks to the slope of the top surface 3 of slab 1 relative to the horizontal H, water can flow between the individual supports to the side of the higher supports 2'. It is not necessary to drain the side of the lower rail supports 2.

Figure 6:
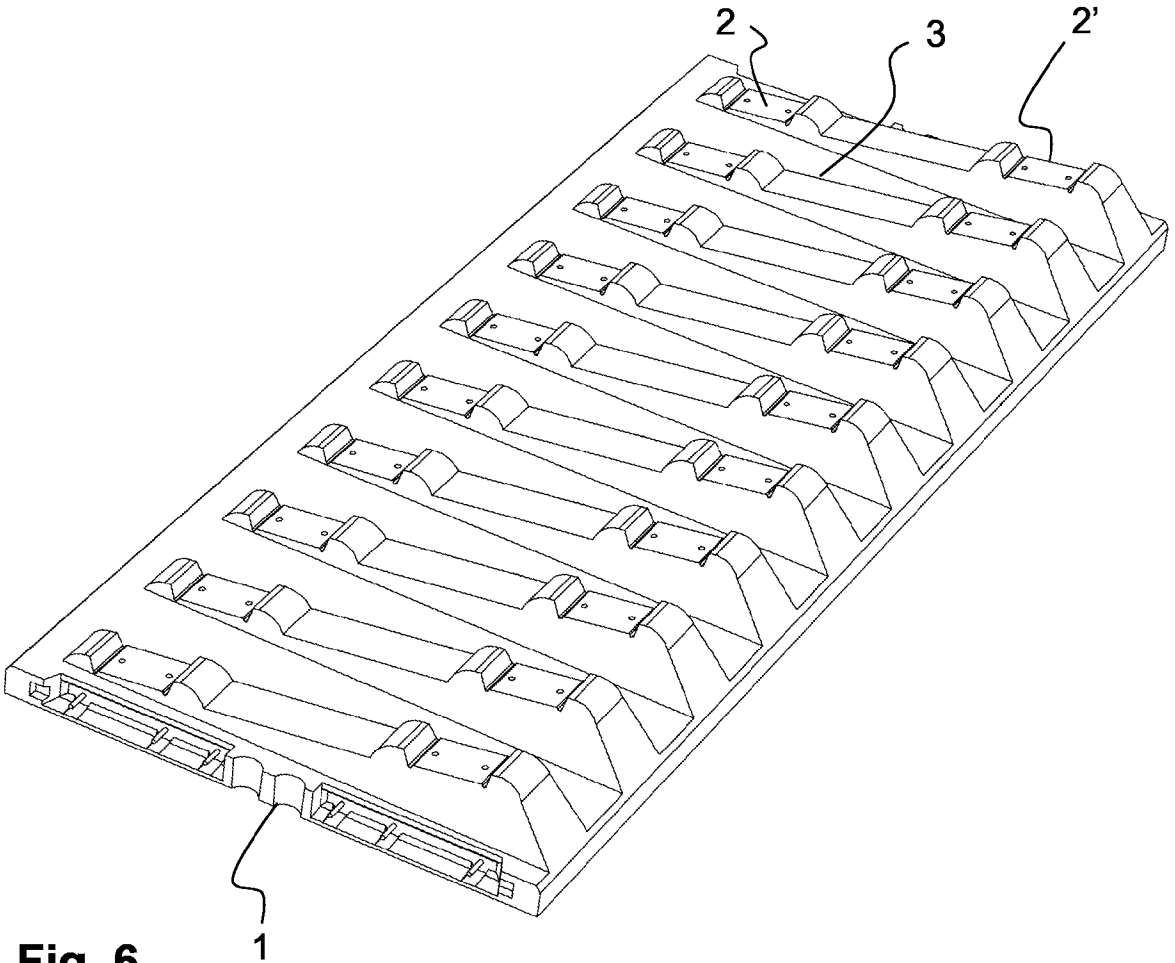
FIG. 6 an execution example of a slab with track-like supports.

FIG. 6 shows another execution example of a concrete slab 1 according to the invention. Here, tie-like rail supports 2, 2' have been placed on the top surface 3 of the slab 1. In this case, rainwater flows through the incline of the top surface 3 with respect to the horizontal H between the individual tie-like rail supports 2, 2', as described above.

Figure 7:
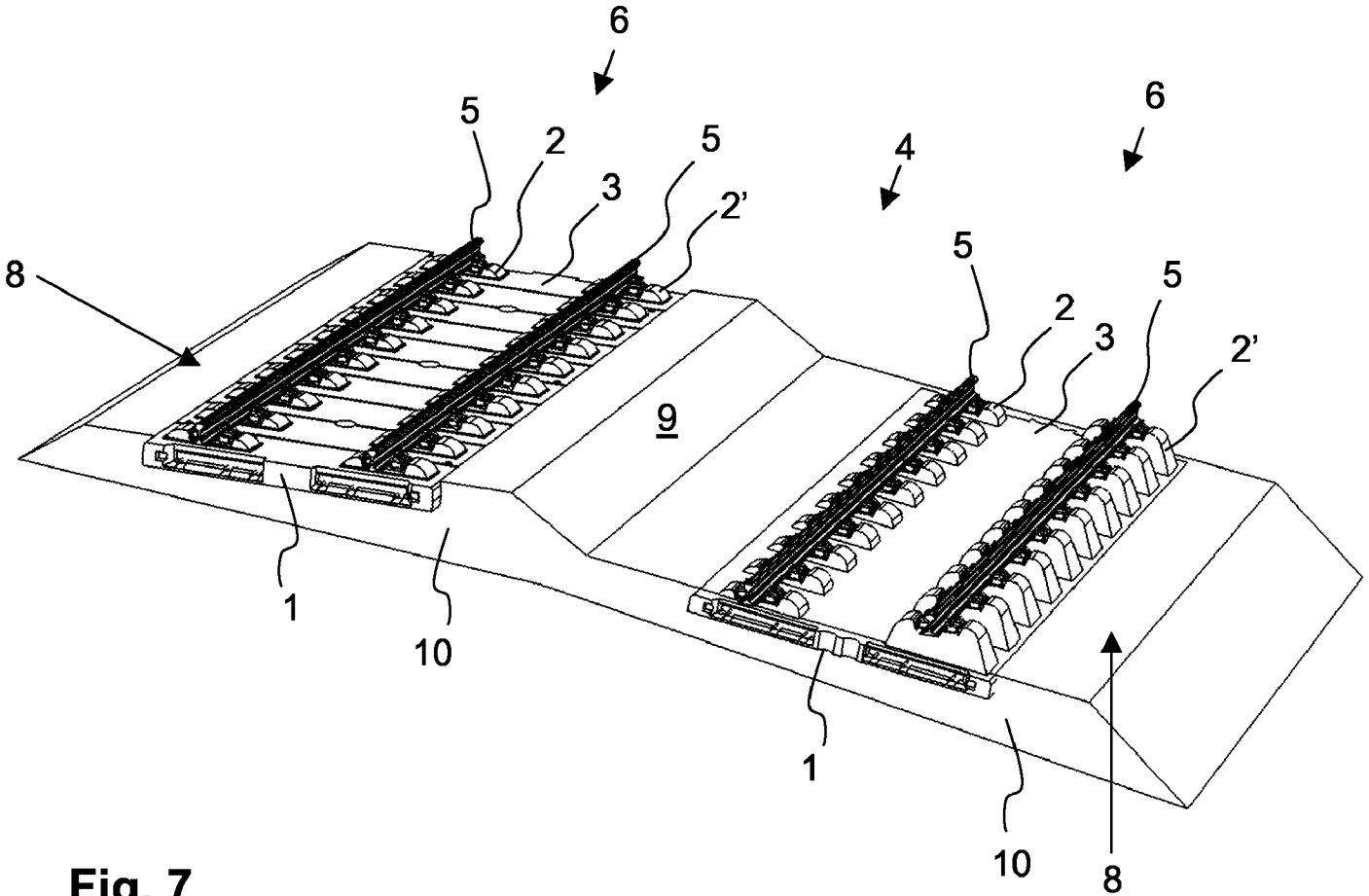
FIG. 7 a track system according to the invention.

FIG. 7 shows a track system 4 according to the invention. The track system 4 consists of two concrete slabs 1 arranged parallel to each other that have in each case numerous rail supports 2 and 2'. The surfaces 3 of the slabs 1 are in each case inclined in such a way that rainwater can flow out to the outer side of the track system. Rails 5 have been fastened to the rail supports 2 and 2'. In each case, two rails 5 make up one track 6 on a slab 1. The top surfaces 3 of both slabs 1 are inclined so they turn away from each other. As a result of this, rainwater can seep through or be diverted to a drainage device. Water from the middle area 9 located between both tracks 6 flows over the top surfaces 3 of the slabs 1 to the external areas 8 as well. To accomplish this, a hydraulically-bound supporting layer 10, on which the slabs 1 have been laid, is arranged high enough on a side of the slabs that rainwater can flow largely out of the middle area 9 without damming, up over the top surface 3 of the slab 1 and finally to the external area 8. For this purpose, the middle area 9 is executed as a series of steps: In this case, one side of the step is executed largely flush with the top surface 3 of the slab 1 shown on the left, and the lower step runs largely flush with the top surface 3 of the right slab 1.

The concrete slabs 1 shown can be made either of pre-assembled concrete or concrete mixed in situ or a combination of both. Now that the angle $\beta$ of the superelevation and the angle $\alpha$ of the top surface of the slab 1 have become independent from one another with respect to the horizontal, another type of construction is naturally possible, in which both $\alpha$ and $\beta$ have the same inclination direction. This can be especially advantageous when the rail superelevation is small, but a larger slope is needed for the reliable diversion of rainwater. Even if drainage in the middle becomes mostly superfluous because of the invention, applications for the concrete slab 1 according to the invention—in which the top surfaces 3 are inclined towards the middle of the track system 4 and drainage takes place via the middle area 9—are nevertheless still possible. In this case, the inclination of the top surface 3 can be executed so strongly regardless from the inclination of track 6 that a fast drainage of the fixed track takes place. However, most of the time the foreseen rail supports will be smaller than the actual superelevation of the rail supports on the top surface 3 of the concrete slab 1. In this case, the incorporation of the concrete slab 1 into the track system will cause a more pronounced inclination of the top surface 3 with respect to the horizontal H than would have been achieved by the rail superelevation alone.

The present invention is not restricted to the execution examples shown here. Rather, numerous modifications are possible within the framework of the patent, and they also fall under the invention's scope of protection.

The invention claimed is:

1. A track system for rail borne vehicles, comprising:

two tracks disposed generally parallel to each other, each track arranged on a respective concrete slab of a fixed track system;

each said slab having rail supports on a top surface thereof configured for laying and fastening two rails running generally parallel to each other;

each of said top surfaces inclined with respect to a horizontal plane;

each of said top surfaces defining a flat planar surface along its entire length; and said top surfaces of said slabs inclined in opposite directions with respect to each other such that water on either of said top surfaces is drained to an external side of said track system and not through said slabs between said rail supports.

2. The track system of claim 1, further comprising a middle area between said slabs that is sloped towards at least one external side of said track system such that water accumulating in said middle area is drained to said external side of said track system.

3. The track system as in claim 2, wherein said middle area comprises a top surface that is at least as high as said top surface of said slab towards which said middle area is sloped such that water in said middle area is drained over said top surface of said slab.

4. The track system as in claim 1, wherein for each said track, said rail supports for a first said rail are arranged higher than said rail supports for a second said rail with respect to said top surface of said slab, and said top surface of said slab is inclined with respect to said horizontal plane towards an external side of said track system.

5. The track system as in claim 4, wherein said rail supports for said first and second rails are arranged in said horizontal plane.

6. The track system as in claim 4, wherein said rail supports for said first and second rails are arranged in a plane inclined with respect to said horizontal plane.

7. The track system as in claim 6, wherein said inclined plane of rail supports for said first and second rails is inclined in an opposite direction with respect to said top surface of said slab.

8. A concrete slab for a fixed track system for rail borne vehicles, comprising:

pairs of rail supports configured on a top surface of said slab for laying and fastening two rails running generally parallel to each other;

said top surface defining a flat planar surface along its entire length;

said rail supports for a first said rail arranged on said top surface higher than said rail supports for a second said rail such that said pairs of rail supports are inclined with respect to said top surface; and wherein said inclination of said top surface of said slab with respect to a plane of said pairs of rail supports results in water draining along said top surface towards an external side of said slab at a desired plane of said rail supports in a track system.

9. The concrete slab as in claim 8, wherein said rail supports for said first and second rails are arranged in an inclined plane with respect to said top surface so as to be in said horizontal plane upon configuration of said slab in said track system.

10. The concrete slab as in claim 8, wherein said rail supports for said first and second rails are arranged in an inclined plane with respect to said top surface so as to be inclined with respect to said horizontal plane upon configuration of said slab in said track system.

11. The concrete slab as in claim 8, wherein said rail supports for said first and second rails are arranged in an inclined plane with respect to said top surface so as to be inclined in an opposite direction with respect to said top surface of said slab upon configuration of said slab in said track system.

12. The concrete slab as in claim 8, wherein said slab comprises a substantially uniform thickness.

13. The concrete slab as in claim 8, wherein said slab is a pre-assembled component of said track system.

14. The concrete slab as in claim 8, wherein oppositely disposed said rail supports are discontinuously disposed on said top surface.

15. The concrete slab as in claim 8, wherein oppositely disposed said rail supports are connected on said top surface.

* * * * *